US009982425B2

(12) United States Patent
Vitarelli et al.

(10) Patent No.: US 9,982,425 B2
(45) Date of Patent: May 29, 2018

(54) DOME STORMWATER CHAMBER

(71) Applicant: Advanced Drainage Systems, Inc., Hilliard, OH (US)

(72) Inventors: Ronald R. Vitarelli, Marlborough, CT (US); Michael Kuehn, Chester, CT (US); John Kurdziel, Fort Wayne, IN (US); David Mailhot, York Beach, ME (US)

(73) Assignee: Advanced Drainage Sysems, Inc., Hilliard, OH (US)

( * ) Notice: Subject to any disclaimer, the term of this patent is extended or adjusted under 35 U.S.C. 154(b) by 0 days. days.

(21) Appl. No.: 15/292,074

(22) Filed: Oct. 12, 2016

(65) Prior Publication Data

US 2018/0100300 A1 Apr. 12, 2018

(51) Int. Cl.
*E03F 1/00* (2006.01)
*E02B 11/00* (2006.01)
*E01F 5/00* (2006.01)

(52) U.S. Cl.
CPC ..... *E03F 1/003* (2013.01); *E01F 5/00* (2013.01); *E02B 11/00* (2013.01)

(58) Field of Classification Search
CPC ..... E03F 1/002; E03F 1/003; E03F 1/005; E02B 11/00; E02B 13/00; E04B 1/3211
USPC ..... 405/45, 46, 49
See application file for complete search history.

(56) References Cited

U.S. PATENT DOCUMENTS 3,897,298 A * 7/1975 Gray ..... E04B 1/166 156/500
4,655,013 A * 4/1987 Ritland ..... E04B 1/14 52/127.9
D337,832 S * 7/1993 Dunne ..... D25/13
5,341,610 A * 8/1994 Moss ..... E04B 1/3211 52/199
5,485,701 A * 1/1996 Hecht ..... E04B 1/3211 446/476
7,744,756 B2 * 6/2010 Davis, Jr. ..... E02B 13/02 210/170.08
8,672,583 B1 * 3/2014 Mailhot ..... E03F 1/003 405/42
9,371,938 B2 * 6/2016 Miskovich ..... F16L 1/11
2003/0115809 A1 * 6/2003 Pontarolo ..... E04B 5/48 52/80.1
2003/0219310 A1 * 11/2003 Burnes ..... E03F 1/003 405/39
2004/0101369 A1 * 5/2004 DiTullio ..... E03F 1/003 405/49
2006/0233612 A1 * 10/2006 DiTullio ..... E03F 1/003 405/46

(Continued)

FOREIGN PATENT DOCUMENTS

WO WO 2010090755 A2 * 8/2010 ..... E03F 1/003

*Primary Examiner* — Frederick L Lagman
(74) *Attorney, Agent, or Firm* — Finnegan, Henderson, Farabow, Garrett & Dunner, LLP

(57) ABSTRACT

This disclosure relates generally to stormwater management and, more particularly, to a stormwater chamber with a continuous curvature. The stormwater chamber may comprise a chamber body with a chamber wall, an apex, a base, and a first and second opening. The chamber wall may include a continuous curvature from the apex of the chamber body to the first and second openings and a continuous curvature from the apex of the chamber body to the base.

16 Claims, 11 Drawing Sheets

(56) References Cited

U.S. PATENT DOCUMENTS

| | | | | |
|---|---|---|---|---|
| 2007/0053746 | A1* | 3/2007 | Dickie | E03F 1/003 405/48 |
| 2009/0025306 | A1* | 1/2009 | Reed | E04B 1/3211 52/80.1 |
| 2009/0220302 | A1* | 9/2009 | Cobb | E03F 1/003 405/49 |
| 2010/0329787 | A1* | 12/2010 | Moore, Jr. | E03F 1/003 405/49 |
| 2011/0308648 | A1 | 12/2011 | Polk et al. | |
| 2015/0260313 | A1* | 9/2015 | Miskovich | F16L 1/11 405/157 |
| 2016/0281347 | A1* | 9/2016 | Miskovich | E04F 15/123 |
| 2016/0369490 | A1* | 12/2016 | Rotondo | B65G 5/00 |

* cited by examiner

420

DOME STORMWATER CHAMBER

FIELD OF THE DISCLOSURE

The present disclosure relates generally to stormwater management and particularly to chambers for retaining and detaining water beneath the surface of the earth.

BACKGROUND OF THE DISCLOSURE

Generally speaking, stormwater management systems are used to accommodate stormwater underground. Depending on the application, stormwater management systems may include pipes, stormwater chambers, and cellular crates, boxes, or columns. After a large rainfall event, stormwater may need to be collected, detained underground in a void space, and eventually dispersed. The stormwater may be dispersed through the process of infiltration, where the water is temporarily stored and then gradually dissipated through the surrounding earth. Alternatively, the stormwater may be dispersed through the process of attenuation, where the water is temporarily stored and then controllably flowed to a discharge point. Modular crates, boxes, and columns with cells are used for both infiltration and attenuation. These stormwater solutions are buried underground and are covered by soil. The cells of these crates, boxes, and columns provide void space to retain stormwater.

However, stormwater solutions that use cellular crates, boxes, and columns have drawbacks. Once installed underground, these systems are subjected to dead loads (from the soil above them) and live loads (from passing vehicular and pedestrian traffic). The dead and live loads create tensional stress and fatigue on the boxes and crates. To carry the load, the boxes and crates require additional internal supports. These internal supports reduce the amount of void space capable of storing stormwater. To compensate, the boxes or crates must occupy a larger area. The cellular column systems, while able to carry vertical loads, lack lateral support. These systems may be subject to stress and fatigue from soil loads on the sides of the columns.

As an alternative to crates, boxes, or columns, stormwater chambers may be used for stormwater retention and detention. Typically, multiple chambers are buried underground to create large void spaces. Stormwater is directed into the underground stormwater chambers where it is collected and stored. The stormwater chambers allow the stormwater to be temporarily stored and then controllably flowed to a discharge point (attenuation) or gradually dissipated through the earth (infiltration).

However, existing stormwater chambers occupy a large land area for the volume of stormwater storage they provide. Current stormwater chambers may be installed in rows and require large amounts of fill soil or gravel between the rows.

There is a need for a stormwater chamber that has a large storage volume per land area and that has the strength, vertical support, and lateral support to withstand dead and live loads when installed. There is also a need for a stormwater chamber with an open void space that can be entirely filled with stormwater. Additionally, there is a need for stormwater chambers that can be economically installed. For example, it is important to reduce the land area required to be excavated and the fill material needed to cover the chambers. There is also a need for stormwater chambers that can be economically shipped and stored. Specifically, there is a need for a stormwater chamber that is lightweight and stacks well with others.

Accordingly, the stormwater chamber and system of the present disclosure provide improvements over the existing technologies.

SUMMARY OF THE DISCLOSURE

In an aspect of the disclosure, a chamber may comprise a chamber body including a chamber wall, an apex, a base, a first opening, and a second opening. The chamber wall may include a continuous curvature from the apex of the chamber body to the first and second openings and a continuous curvature from the apex of the chamber body to the base.

In another aspect of the disclosure, a stormwater management system may comprise at least two chambers coupled together. Each chamber may include a chamber body having a chamber wall, an apex, a base, a first opening, and a second opening. The chamber wall may include a continuous curvature from the apex of the chamber body to the first and second openings and a continuous curvature from the apex of the chamber body to the base. One of the first and second openings of a first chamber may be coupled to one of the first and second openings of a second chamber.

In yet another aspect of the disclosure, a chamber may comprise a chamber body including a chamber wall, an apex, a base, a first opening, and a second opening; a first coupling structure positioned around the first opening; and a second coupling structure positioned around the second opening. The chamber wall may include a continuous curvature from the apex of the chamber body to the base, and the base may curve outward in a horizontal direction from the first and second coupling structures.

DETAILED DESCRIPTION

Reference will now be made in detail to the exemplary embodiments of the present disclosure described above and illustrated in the accompanying drawings.

Figure 1:
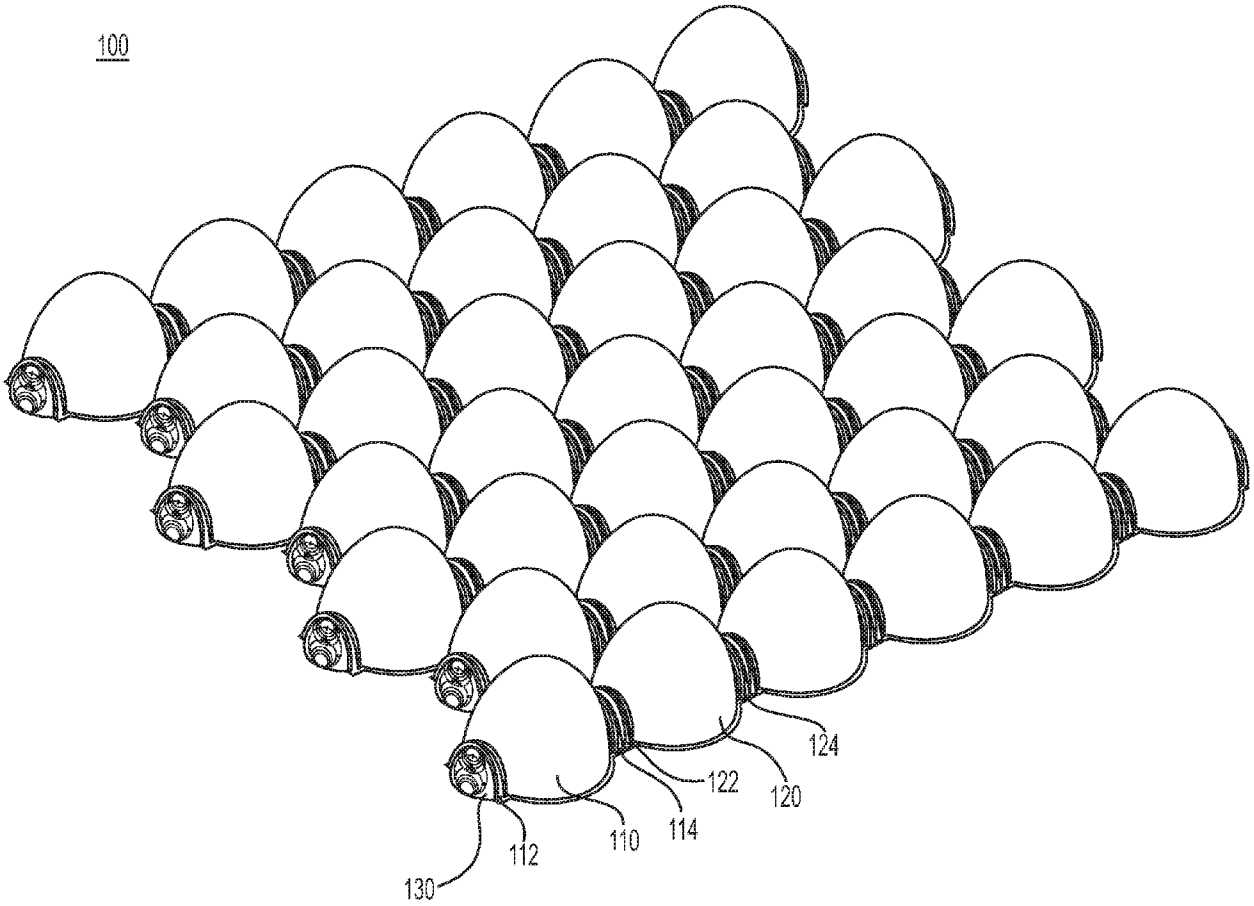
FIG. 1 is a perspective view of an exemplary stormwater chamber array according to an exemplary disclosed embodiment.

FIG. 1 illustrates a perspective view of an exemplary stormwater chamber array 100. Stormwater chamber array 100 may include multiple individual stormwater chambers 110, 120 arranged and configured to collect, store, and drain a fluid. Stormwater chamber array 100 may be disposed underground. For example, stormwater chamber array 100 may be installed under a road, sidewalk, field, lot, or other ground surface. Stormwater chamber array 100 may be buried underground and surrounded by a fill material such as soil, sand, stone, gravel, or other appropriate material. Stormwater chamber array 100 may be placed on a geotextile covered surface. In one embodiment, stormwater chamber array 100 may be buried with a depth of foundation stone of approximately 12 inches. Stormwater chamber array 100 may be covered in a geotextile and buried under approximately 12 inches of fill material. It should be appreciated that the depth of the foundation stone and the depth of the fill material may vary based on the type of foundation stone and fill material and the expected live and dead loads.

Stormwater chamber array 100 may collect and store stormwater. Stormwater chamber array 100 may also allow stormwater to controllably flow to a discharge point (attenuation) or gradually dissipate through the earth (infiltration). Stormwater chamber array 100 may be applicable in various other drainage settings. For example, stormwater chamber array 100 may be utilized in connection with agricultural uses, mining operations, sewage disposal, storm sewers, recreational fields, timber activities, landfill and waste disposal, road and highway drainage, sanitation effluent management, and residential and commercial drainage applications for transporting and draining various types of fluids.

Stormwater chamber array 100 may include individual stormwater chambers aligned in rows. In some embodiments, stormwater chambers 110, 120 may be connected end-to-end together. In one embodiment, stormwater chamber 110 may include a first coupling structure 112 at a first end of stormwater chamber 110 and a second coupling structure 114 at a second end of stormwater chamber 110. Storm water chamber 120 may include a first coupling structure 122 at a first end and a second coupling structure 124 at a second end of stormwater chamber 120. Second coupling structure 114 of stormwater chamber 110 may be connected to first coupling structure 122 of stormwater chamber 120. Second coupling structure 124 of stormwater chamber 120 may be connected to first coupling structure 112 or second coupling structure 114 of an adjacent stormwater chamber. The coupling structures 112, 114, 122, 124 may be coupled together by overlapping or underlapping as described herein. Any number of stormwater chambers 110, 120 may be aligned and connected by coupling structures 112, 114, 122, 124. Rows of stormwater chambers 110, 120 may be configured to receive stormwater from a pipe, chamber, or other drainage component. Stormwater may flow between the stormwater chambers 110, 120 via coupling structures 112, 114, 122, 124. For example, stormwater may flow between stormwater chamber 110 and stormwater chamber 120 via coupling structures 114 and 122.

An end of each row of stormwater chambers may include an endcap to contain the stormwater in the row and prevent intrusion of the surrounding fill material. In one embodiment, coupling structure 112 of stormwater chamber 110 may be fitted with an endcap 130. End cap 130 may be removably attached to coupling structure 112. It should be appreciated that in other embodiments, end cap 130 may be integrally formed with coupling structure 112. In some embodiments, endcap 130 may be a completely solid cap, thereby creating a water-tight seal at the first end of stormwater chamber 110. In other embodiments, endcap 130 may include an opening through which a pipe of an appropriate diameter may fluidly interface with stormwater chamber 110. In other embodiments, endcap 130 may include circular cut lines of various diameters to accommodate a variety of different sized pipes. A user or installer may cut an opening to allow a pipe of a certain diameter to interface with stormwater chamber 110. A pipe that interfaces with stormwater chamber 110 through endcap 130 may deliver stormwater and allow it to enter stormwater chamber 110.

In other embodiments, stormwater chambers 110, 120 may not have coupling structures. Stormwater chambers 110, 120 may be aligned end-to-end with one another but may not be fluidly connected to one another.

As illustrated in FIG. 1, stormwater chamber array 100 may comprise rows of stormwater chambers arranged adjacent to each other. The adjacent rows may be arranged staggered with respect to each other. That is, the middle of the base of each stormwater chamber in a row may be positioned between coupling structures of the stormwater chambers in an adjacent row. The stormwater chambers in adjacent rows may be aligned close to or touching each other. Such an arrangement may minimize empty space between rows, which in turn may minimize the land area and fill volume of stormwater chamber array 100. In one embodiment, stormwater chambers 110, 120 may have a height of approximately 60 inches and a width of approximately 90 inches. In this embodiment, the midpoint in the center of chamber 110 is arranged 96 inches away from the midpoint in the center of chamber 120. In other words, the midpoint of each chamber aligned in the same row is positioned 96 inches apart. The midline of chambers in adjacent rows may be arranged to be 84 inches apart. It should be appreciated that the number of individual stormwater chambers in a row or array and the number of rows in an array may be selected based on the drainage application and the desired storage volume. It should also be appreciated that the spacing between chambers within the same row and the spacing between adjacent rows may be selected based on the available land area for the drainage application.

Figure 2A:
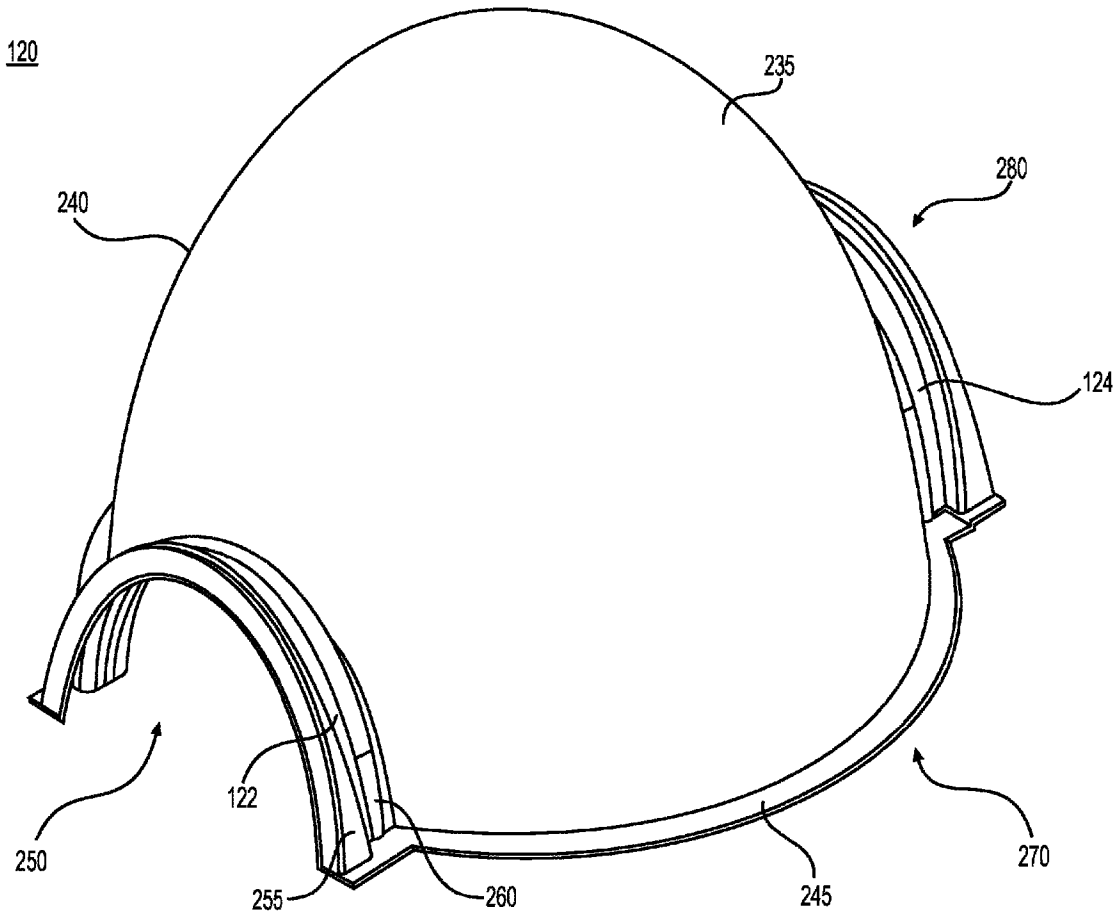
FIG. 2A is a perspective view of a single stormwater chamber according to an exemplary disclosed embodiment.

FIG. 2A illustrates a perspective view of stormwater chamber 120.

Although not included in the figures, it should be appreciated that the foregoing description and disclosure of stormwater chamber 120 also applies to stormwater chamber 110. Stormwater chamber 120 may be placed on a geotextile covered surface and may be covered in a geotextile. Stormwater chamber 120 may include a chamber body 235 with first and second coupling structures 122 and 124 positioned on opposite sides of chamber body 235. Chamber body 235 may be dome-shaped. Chamber body 235 may include a wall 240 that may curve outward from the apex of chamber body 235 to an open base 270 at the bottom of chamber body 235. Base 270 may curve outward in horizontal directions from first and second coupling structures 122 and 124. Accordingly, in one embodiment, chamber body 235 may include a semi-ellipsoid. It should be appreciated, however, that chamber body 235 may include other dome-shaped configurations such as, for example, a semi-paraboloid, a semi-spheroid, and semi-egg-shaped. It should also be appreciated that a cross sectional shape of chamber body 235 along a horizontal plane above first and second coupling structures 122 and 124 may be substantially circular. In other embodiments, the cross sectional shape may be substantially elliptical.

Stormwater may be stored in the void inside chamber body 235. Chamber body 235 may have a height and width of appropriate dimensions to facilitate a desired volume of stormwater storage. In one embodiment, chamber body 235 may have a height of approximately 60 inches and a width of approximately 90 inches. Accordingly, chamber body 235 may have a storage volume of approximately 140 to 150 cubic feet. It should be appreciated that chamber body 235 may have any other height or width to achieve other desired stormwater storage volumes.

As illustrated in FIG. 2A, base 270 of chamber body 235 may be substantially circular with a foot 245 extending horizontally from base 270. In other embodiments, base 270 of chamber body 235 may be substantially elliptical with foot 245 extending horizontally from base 270. In still other embodiments, base 270 of chamber body 235 may be shaped like a discontinuous circle or a discontinuous ellipse with foot 245 extending horizontally from base 270. In these embodiments, the circular or elliptical shape of the base is discontinuous to allow for a first opening 250 and a second opening 280 in chamber body 235. In some embodiments, foot 245 may be approximately 3 inches wide. A multiplicity of spaced apart fins, commonly called stacking lugs, (not pictured) may extend upwardly from foot 245. The stacking lugs may support foot 245 of an overlying nested chamber, to stop nested chambers from jamming during shipment or storage. The height of the stacking lugs may be chosen so that the corrugations of nested chambers may come very close, or into light contact with each other, without wedging together.

In the embodiment depicted in FIG. 2A, for example, the curved, dome shape of chamber body 235 may allow stormwater chamber 120 to distribute dead and live loads around chamber body 235 and shed those loads into the ground. The dome shape of chamber body 235 may reduce tensile stress and strain on stormwater chamber 120. As a result, stormwater chamber 120 may carry and distribute greater loads over a longer period of installation. Chamber body 235 may not require any additional internal support structures to help carry the live and dead loads. Therefore, the entire void space created by chamber body 235 may be used for stormwater storage.

As illustrated in FIG. 2A, and alluded to above, wall 240 of chamber body 235 may be continuously curving. Wall 240 of chamber body 235 may be continuously curving from the apex of chamber body 235 to base 270 of chamber body 235. Wall 240 of chamber body 235 may also be continuously curving from the apex of chamber body 235 to the apexes of coupling structures 122, 124 (and the apexes of openings 250, 280).

In some embodiments, the outer surface of wall 240 may be substantially smooth. In other embodiments, the outer surface of wall 240 may contain vertical stiffening ribs. The ribs may be spaced apart around base 270 and outwardly projecting from the outer surface of wall 240. The ribs may extend vertically upward from foot 245 along the outer surface of wall 240. In some embodiments, the ribs may be located on only the lower portion of wall 240. In other embodiments, the ribs may extend to the upper portion of wall 240. In still other embodiments, the ribs may extend over the entire wall 240. In other embodiments, wall 240 may contain corrugations, as described herein. In some embodiments, the top portion of chamber body 235 may include holes, slits, slots, valves, or other openings (not pictured) to allow the release of confined air as stormwater chamber 120 fills with fluid. In some embodiments, top portion of chamber body 235 may include a flat circular surface for accepting an optional inspection port (not pictured). The flat circular surface may be cut out and fitted with an inspection port having a circular cross-section. The inspection port may be opened to allow access to the interior of stormwater chamber 120. The top portion of chamber body 235 may also include a multiplicity of stacking lugs positioned around the flat circular surface and extending upwardly from top portion of chamber body 235.

As discussed above, stormwater chamber 120 may also include first and second coupling structures 122, 124. In some embodiments, first and second coupling structures 122, 124 may be positioned on opposite sides of chamber body 235. It should be appreciated, however, that first and second coupling structures 122, 124 may be positioned in any other suitable configuration relative to each other. For example, in some embodiments, first coupling structure 122 may be positioned substantially perpendicular to second coupling structure 124. First and second coupling structures 122, 124 may be arch-shaped and extend horizontally from the sides of chamber body 235.

As described above, stormwater may flow between stormwater chambers 110, 120 via coupling structures 112, 114, 122, 124. To that end, chamber body 235 may include a first opening 250 and a second opening 280, wherein one of the openings may serve as an inlet into the void of chamber body 235, and the other opening may serve as an outlet from the void of chamber body 235. As shown in FIG. 2A, first opening 250 and second opening 280 may include an arch-shaped configuration. In one embodiment, first opening 250 and second opening 280 may have a width of approximately 51 inches and a height of approximately 30 inches. Accordingly, the height of first opening 250 and second opening 280 may be approximately half the height of chamber body 235. It should be appreciated, however, that in other embodiments, the width and height of first opening 250 and second opening 280 may be different sizes depending on the desired flow rate into chamber 120. First coupling structure 122 and second coupling structure 124 may respectively be positioned around first opening 250 and second opening 280. Accordingly, first coupling structure 122 and second coupling structure 124 may also include an arch-shaped configuration. First coupling structure 122 and second coupling structure 124 may have a width of 51 inches and a height of 30 inches. It should be appreciated, however, that in other embodiments, the width and height of first coupling structure 122 and second coupling structure 124 may be different sizes depending on the size of first opening 250 and second opening 280. It should also be appreciated that in other embodiments, openings 250, 280 and coupling structures 122, 124 may include any other suitable shape, such as, for example, rectangular-shaped, square-shaped, and semi-circle-shaped. In still other embodiments, chamber body 235 may have no openings.

Figure 2B:
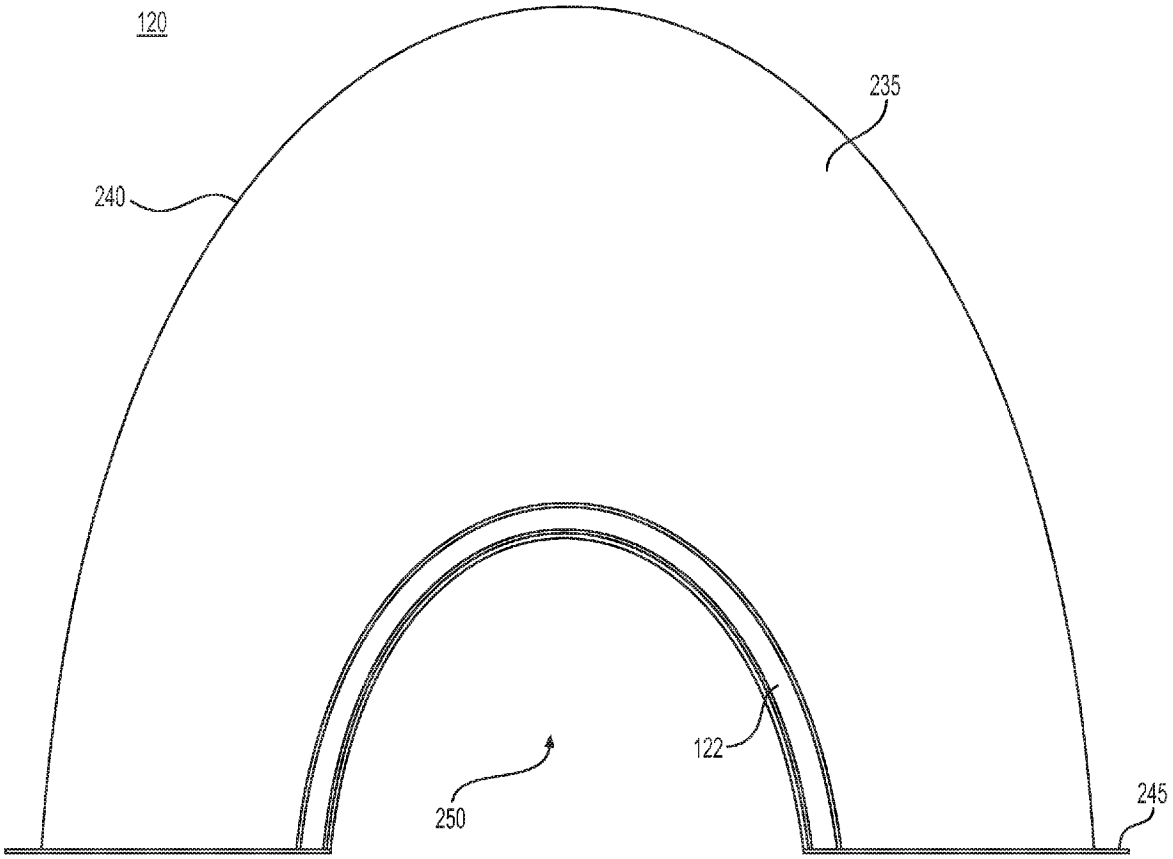
FIG. 2B is a front elevation view of the single stormwater chamber of FIG. 2A according to an exemplary disclosed embodiment.

FIG. 2B illustrates a front elevation view of stormwater chamber 120. In some embodiments, stormwater may be directed to openings 250, 280 by way of pipes, chambers, or other stormwater management components. Sides of coupling structures 122, 124 may rise upwardly from foot 245 and curve inwardly to the apex of coupling structures 122, 124. The apex of coupling structures 122, 124 may be positioned below the apex of chamber body 235. In some embodiments, the height of coupling structures 122, 124 may be half the height of chamber body 235. It should be appreciated, however, that the dimensions of coupling structures 122, 124 may vary based on the desired storage capacity of stormwater chamber 120, the desired size of openings 250, 280, and the desired flow rate of stormwater into chamber 120.

Figure 2C:
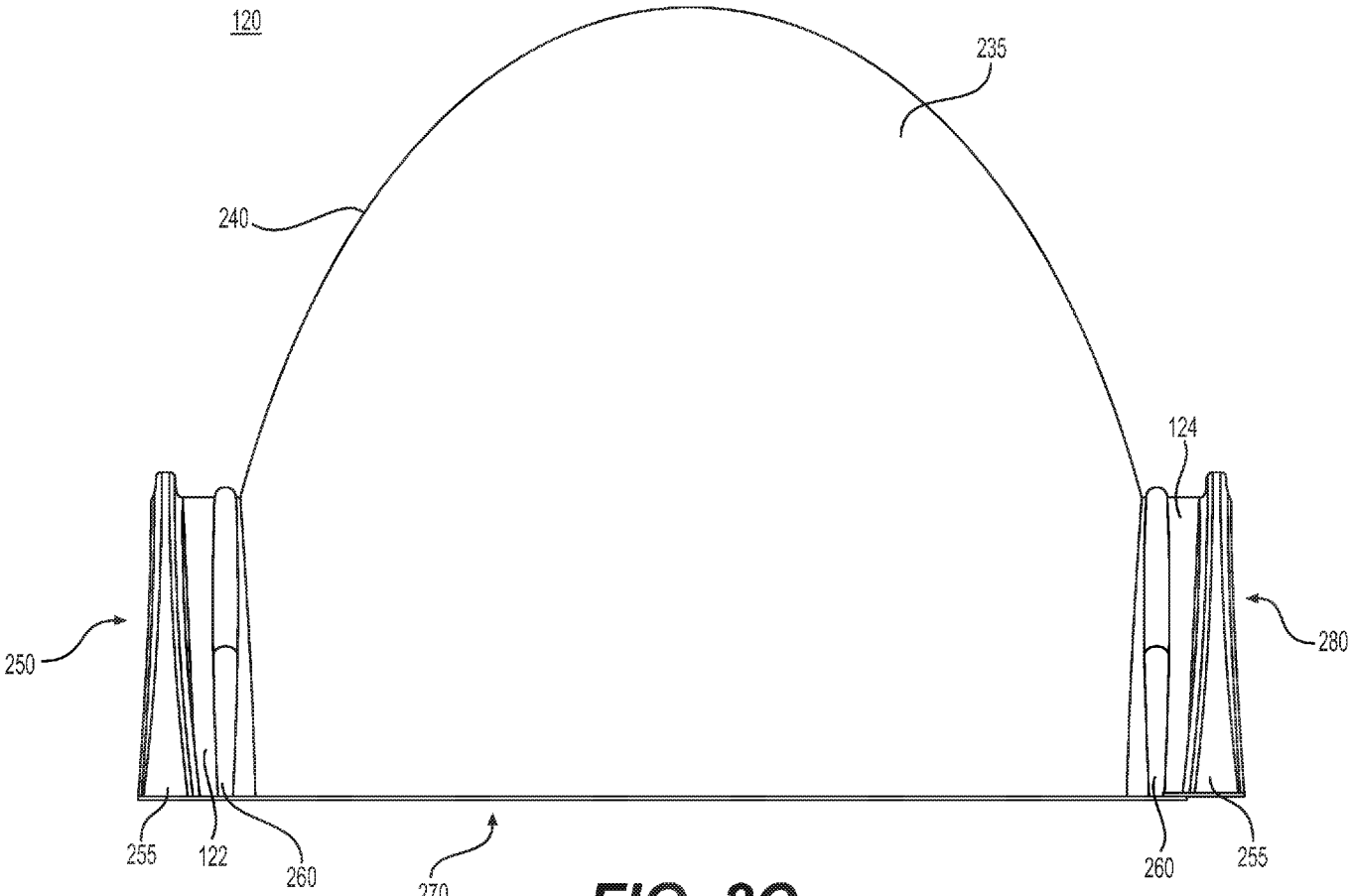
FIG. 2C is a side elevation view of the single stormwater chamber of FIG. 2A according to an exemplary disclosed embodiment.

FIG. 2C illustrates a side elevation view of stormwater chamber 120. As shown in FIG. 2C, first coupling structure 122 may include an end corrugation 255 and a body corrugation 260. Similarly, second coupling structure 124 may include an end corrugation 255 and a body corrugation 260. End corrugations 255 and body corrugations 260 may extend upwardly from foot 245. As shown in FIG. 2C, end corrugations 255 and body corrugations 260 may extend from foot 245 and over the entire arch-shaped body of coupling structures 122, 124. In some embodiments, end corrugations 255 and body corrugations 260 may extend upward from foot 245 to a portion of coupling structures 122, 124 lower than the apex. Although not illustrated, coupling structures 112, 114 of stormwater chamber 110 may also include end corrugations 255 and body corrugations 260. End corrugations 255 and body corrugations 260 may strengthen coupling structures 112, 114, 122, 124 by preventing buckling. In addition, end corrugations 255 and body corrugations 260 may facilitate the coupling of stormwater chambers 110, 120 to other stormwater chambers.

A series of stormwater chambers 110, 120 may be aligned and connected end-to-end by coupling structures 112, 114, 122, 124. For example, coupling structures 122, 124 of stormwater chamber 120 may be arranged to overlap or underlap coupling structures 122, 124 of another stormwater chamber 120. Moreover, coupling structures 122, 124 of stormwater chamber 120 may be arranged to overlap or underlap one of the coupling structures 112 and 114 of stormwater chamber 110. The other coupling structure 112, 114 of stormwater chamber 110 may be coupled to end cap 130. One or both of end corrugations 255 and body corrugations 260 may facilitate the interlocking of coupling structures 122, 124. For example, both end corrugation 255 and body corrugation 260 of coupling structures 122, 124 of stormwater chamber 120 may overlap or underlap end corrugation 255 and body corrugation 260 of coupling structures 122, 124 of another stormwater chamber 120. In other embodiments, only end corrugation 255 of coupling structure 122, 124 of stormwater chamber 120 may overlap or underlap end corrugation 255 of coupling structure 122, 124 of another stormwater chamber 120. When coupling structures 112, 114, 122, 124 are overlapped or underlapped with one another, end corrugations 255 and body corrugations 260 may interface and prevent stormwater chambers 110, 120 from sliding apart. The interlocking of end corrugations 255 (and body corrugations 260 in some embodiments) may also create a water-tight connection between stormwater chambers 110, 120.

It should also be appreciated that end corrugations 255 and body corrugations 260 may facilitate ease and stability of stacking stormwater chambers 110, 120. For storing and shipping, stormwater chambers 110, 120 may be stacked vertically. When stacked, chamber bodies 235 may nest with each other. Coupling structures 112, 114, 122, 124, with their end corrugations 255 and body corrugations 260, may also nest with each other and keep stormwater chambers 110, 120 from sliding during storage and shipping.

Coupling structures 112, 114, 122, 124 may also provide additional storage volume for stormwater chambers 110, 120. The arch-shaped configuration of coupling structures 112, 114, 122, 124 may provide a volume to store stormwater that may enter and/or exit chamber body 235. It should therefore be appreciated that coupling structures 112, 114, 122, 124 may increase the overall storage volume of stormwater chambers 110, 120. In some embodiments, both coupling structures 112, 114 of stormwater chamber 110 and both coupling structures 122, 124 of stormwater chamber 120 may be fitted with endcaps 130 to create single, stand-alone stormwater chambers.

Figure 2D:
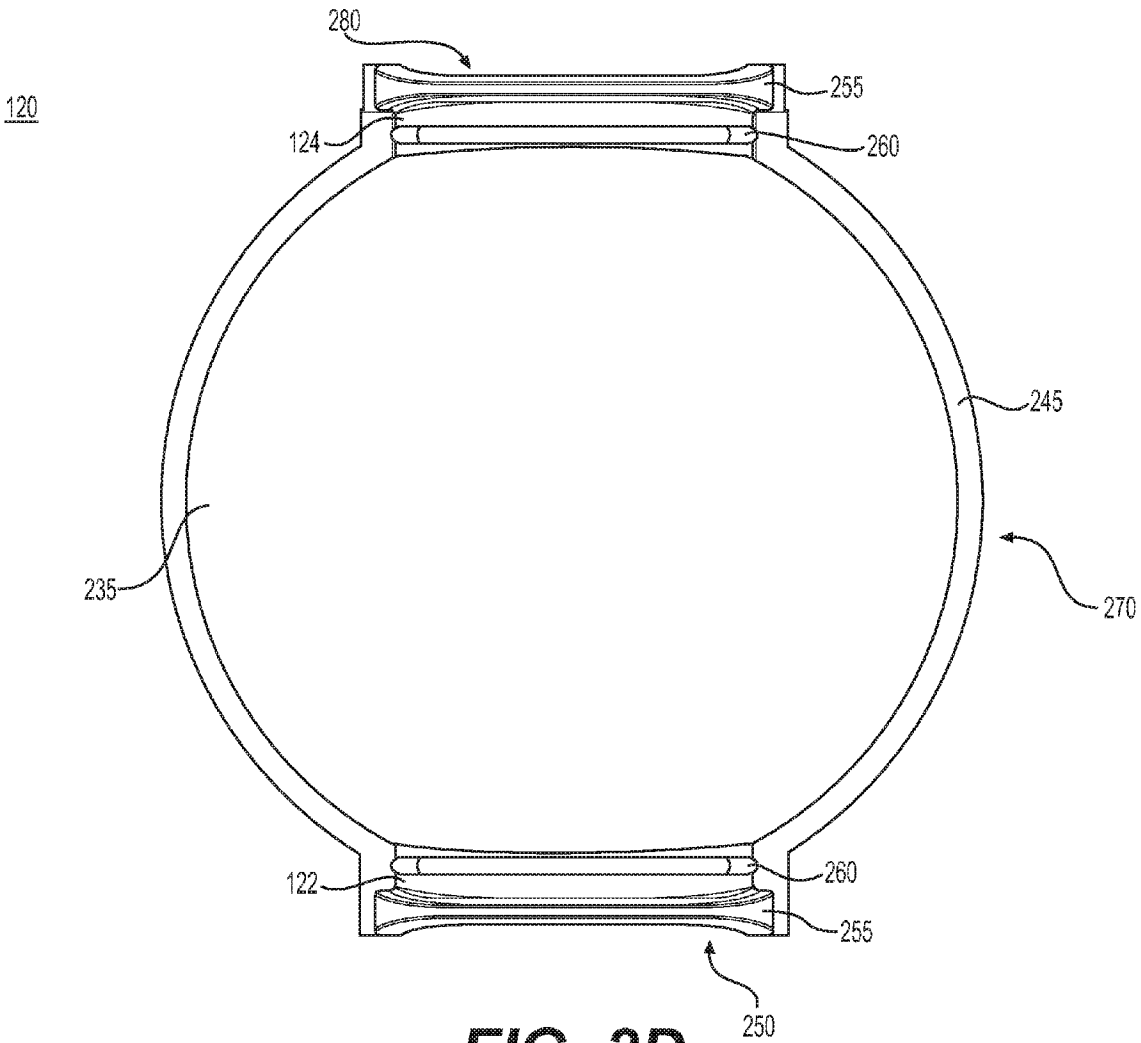
FIG. 2D is a top plan view of the single stormwater chamber of FIG. 2A according to an exemplary disclosed embodiment.

FIG. 2D illustrates a top plan view of stormwater chamber 120. As shown in FIG. 2D, base 270 may include a substantially circular shape. It should be appreciated, however, that base 270 may include other curved configurations, such as a substantially elliptical shape. Foot 245 may extend horizontally from base 270 and coupling structures 122, 124.

Figure 3:
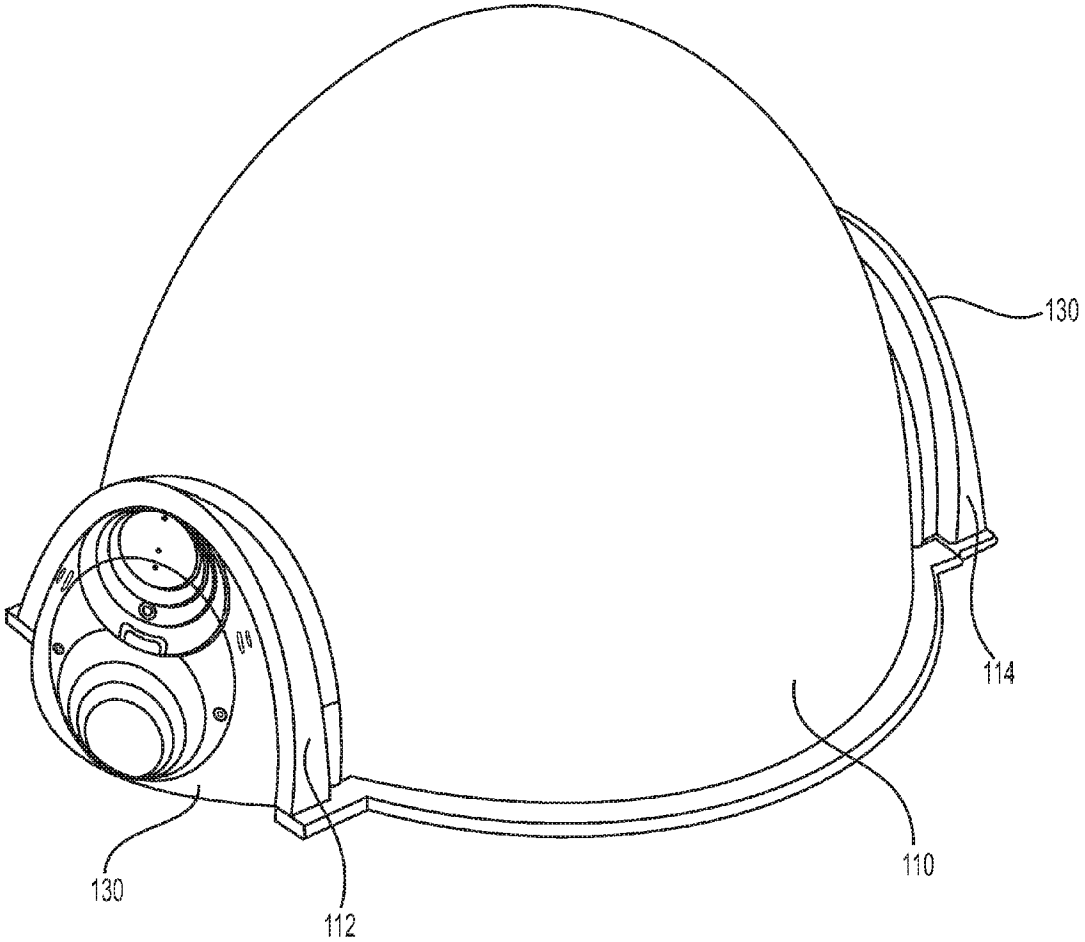
FIG. 3 is a perspective view of a single, stand-alone stormwater chamber according to an exemplary disclosed embodiment.

FIG. 3 illustrates a perspective view of a single, stand-alone stormwater chamber 110. Both coupling structures 112, 114 of stormwater chamber 110 may be fitted with endcaps 130 to create a single, stand-alone stormwater chamber.

Figure 4A:
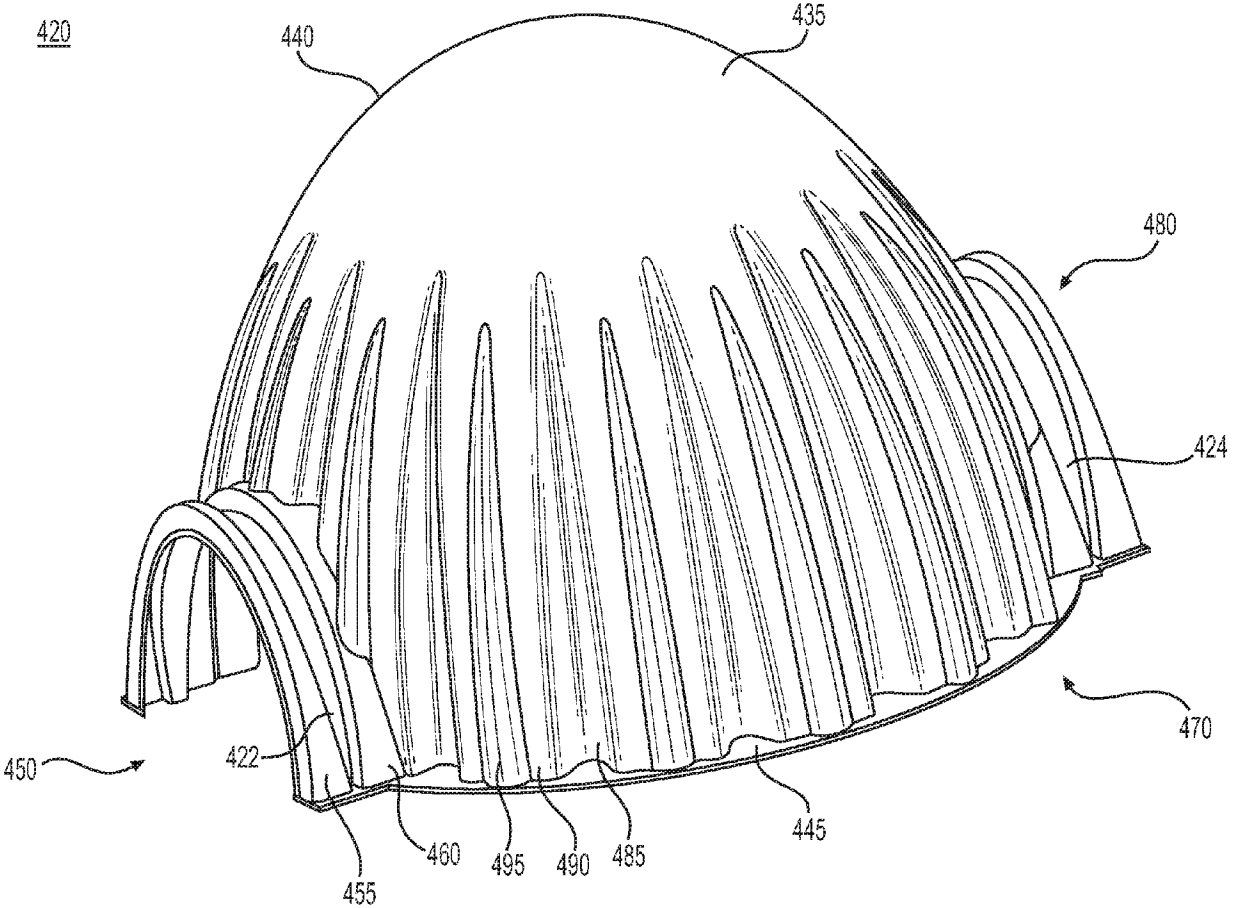
FIG. 4A is a perspective view of a single stormwater chamber according to an exemplary disclosed embodiment.

FIG. 4A illustrates a perspective view of stormwater chamber 420. Stormwater chamber 420 is substantially similar to stormwater chamber 110 and stormwater chamber 220. Stormwater chamber 420 may include a chamber body 435 with first and second coupling structures 422 and 424 positioned on opposite sides of chamber body 435. Chamber body 435 may include a wall 440 that may curve outward from the apex of chamber body 435 to an open base 470 at the bottom of chamber body 435.

As shown in FIG. 4A, wall 440 may contain a multiplicity of corrugations. The corrugations may be comprised of crest corrugations 490 and valley corrugations 485. The corrugations may be evenly spaced around base 470. In some embodiments, the corrugations may contain sub-corrugations. Each corrugation may have a width, a depth, and a length. The width of a corrugation is measured in a plane parallel to a tangent to wall 440. The depth of a corrugation is measured in a plane normal to a tangent to wall 440. The length of a corrugation is a measure of the dimension of the corrugation as it runs along wall 440 of the chamber. The width and depth of the corrugations may vary with elevation measuring vertically upward from foot 445 along wall 440.

In some embodiments, the width of crest corrugations 490 may remain constant with increasing elevation from foot 445. In other embodiments, the width of crest corrugations 490 may decrease with increasing elevation. In some embodiments, the width of valley corrugations 485 may decrease with increasing elevation. In some embodiments, the depth of crest corrugations 490 and valley corrugations 485 may decrease with increasing elevation. In some embodiments, crest corrugations 490 may have a length that terminates on the lower portion of wall 440. In other embodiments, crest corrugations 490 may have a length that terminates on the upper portion of wall 440.

In some embodiments, valley corrugations 485 may terminate on the lower portion of wall 440. In other embodiments, valley corrugations 485 may terminate on the upper portion of wall 440. When crest corrugations 490 reach an elevation greater than the terminal ends of valley corrugations 485, crest corrugations 490 merge with each other and form wall 440. Wall 440 may be smooth at the apex of chamber body 435. In still other embodiments, valley corrugations 485 may extend over the entire wall 440. In some embodiments, the top portion of chamber body 435 may include holes, slits, slots, valves, or other openings to allow the release of confined air as stormwater chamber 420 fills with fluid.

In some embodiments, the corrugations may contain sub-corrugations. Crest corrugations 490 may contain crest sub-corrugations 495. Crest sub-corrugations 495 may be smaller than crest corrugations 490. In some embodiments, the width of crest sub-corrugations 495 may decrease with increasing elevation. In other embodiments, the width of crest sub-corrugations 495 may remain constant with increasing elevation. In some embodiments, the depth of crest sub-corrugations 495 may decrease with increasing elevation. In other embodiments, the depth of crest sub-corrugations 495 may remain constant with increasing elevation. Valley corrugations 485 may contain valley sub-corrugations. Valley sub-corrugations may be smaller than valley corrugations 485. The width and depth of valley sub-corrugations may vary with increasing elevation.

Including crest and valley corrugations may increase the strength of the chamber in both the horizontal and vertical directions. The corrugations may help resist buckling caused by compression forces in the chamber wall. Corrugations may provide this additional strength without adding unnecessary material. Sub-corrugations within the crest corrugations, valley corrugations, or crest and valley corrugations provide additional strength with minimal additional material and weight. The corrugations may provide the additional advantage of securing stormwater chambers when they are stacked vertically and nested with one another.

Figure 4B:
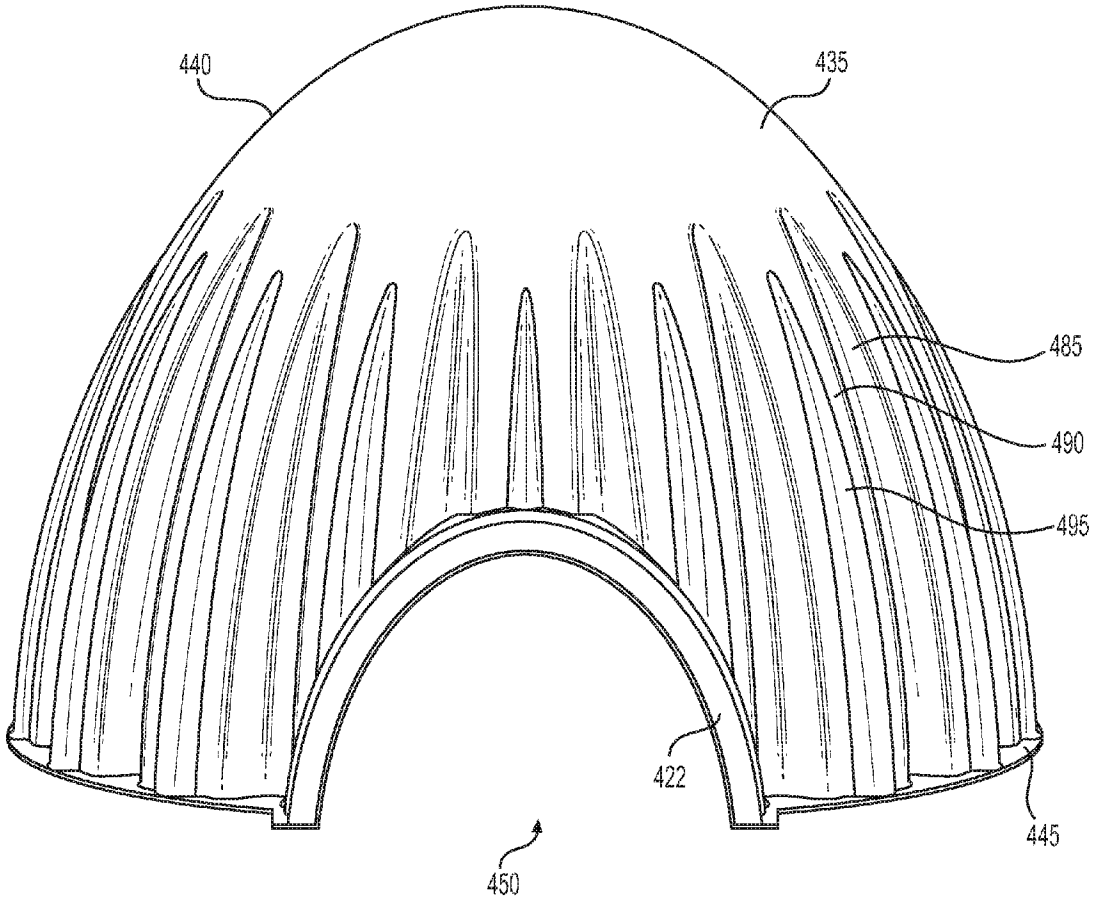
FIG. 4B is a front elevation view of the single stormwater chamber of FIG. 4A according to an exemplary disclosed embodiment.

FIG. 4B illustrates a front elevation view of the single stormwater chamber of FIG. 4A according to an exemplary disclosed embodiment. In some embodiments, stormwater may be directed to openings 450, 480 by way of pipes, chambers, or other stormwater management components. Sides of coupling structures 422, 424 may rise upwardly from foot 445 and curve inwardly to the apex of coupling structures 422, 424. The apex of coupling structures 422, 424 may be positioned below the apex of chamber body 435. In some embodiments, the height of coupling structures 422, 424 may be half the height of chamber body 435. Where coupling structures 422, 424 form openings 450, 480, crest corrugations 490, valley corrugations 485, and crest sub-corrugations 495 may originate from coupling structures 422, 424.

Figure 4C:
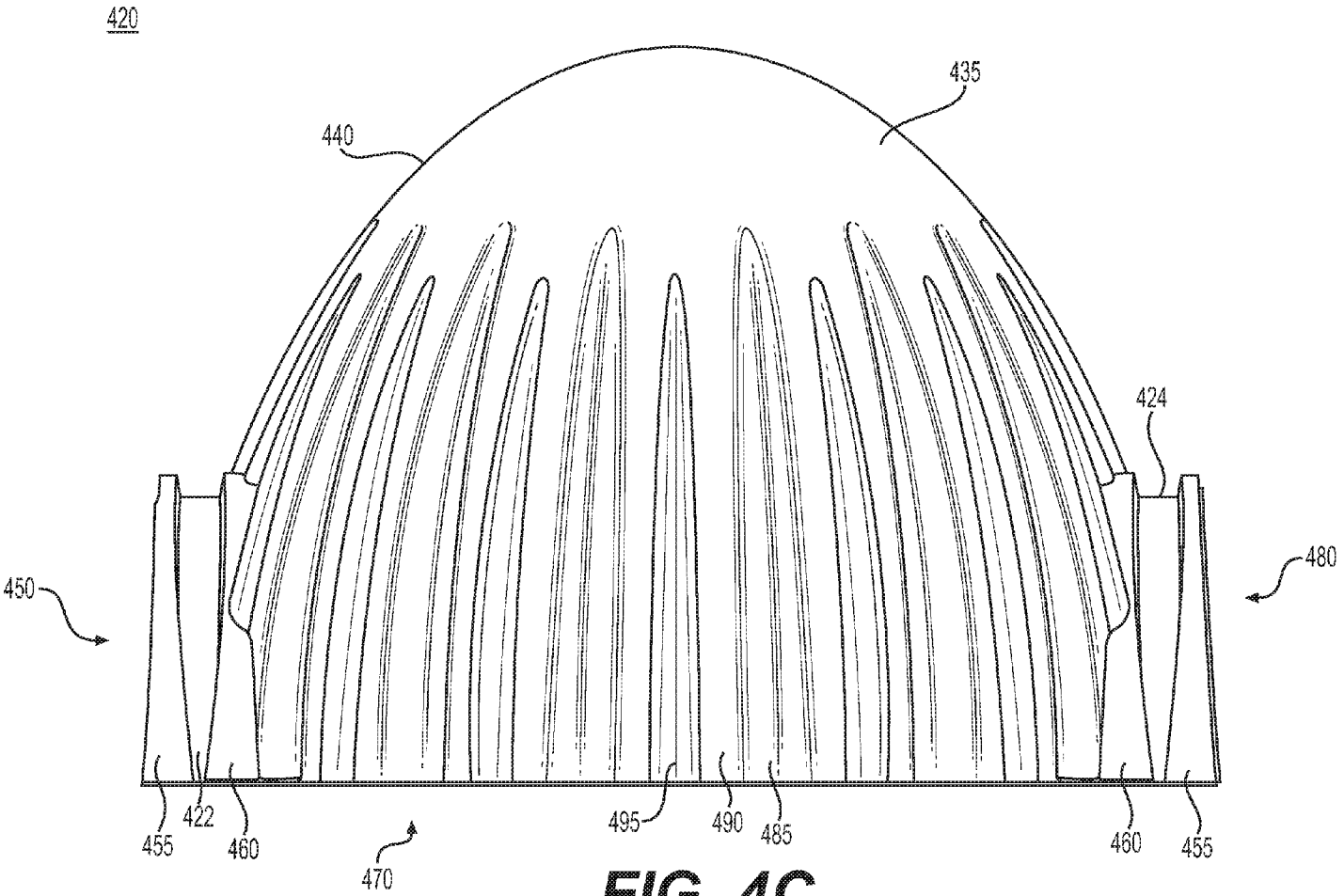
FIG. 4C is a side elevation view of the single stormwater chamber of FIG. 4A according to an exemplary disclosed embodiment.

FIG. 4C illustrates a side elevation view of stormwater chamber 420. As shown in FIG. 4C, first coupling structure 422 and second coupling structure 424 may include an end corrugation 455 and a body corrugation 460. Crest corrugations 490, valley corrugations 485, and crest-sub corrugations 495 may originate from coupling structures 422, 424. Crest corrugations 490 and valley corrugations 485 may be connected to body corrugation 460 of coupling structures 422, 424. End corrugations 455 and body corrugations 460 may extend upwardly from foot 445. As shown in FIG. 4C, end corrugations 455 and body corrugations 460 may extend from foot 445 and over the entire arch-shaped body of coupling structures 422, 424. In some embodiments, end corrugations 455 and body corrugations 460 may extend upward from foot 445 to a portion of coupling structures 422, 424 lower than the apex. End corrugations 455 and body corrugations 460 may strengthen coupling structures 412, 414, 422, 424 by preventing buckling. In addition, end corrugations 455 and body corrugations 460 may facilitate the coupling of stormwater chambers.

Figure 4D:
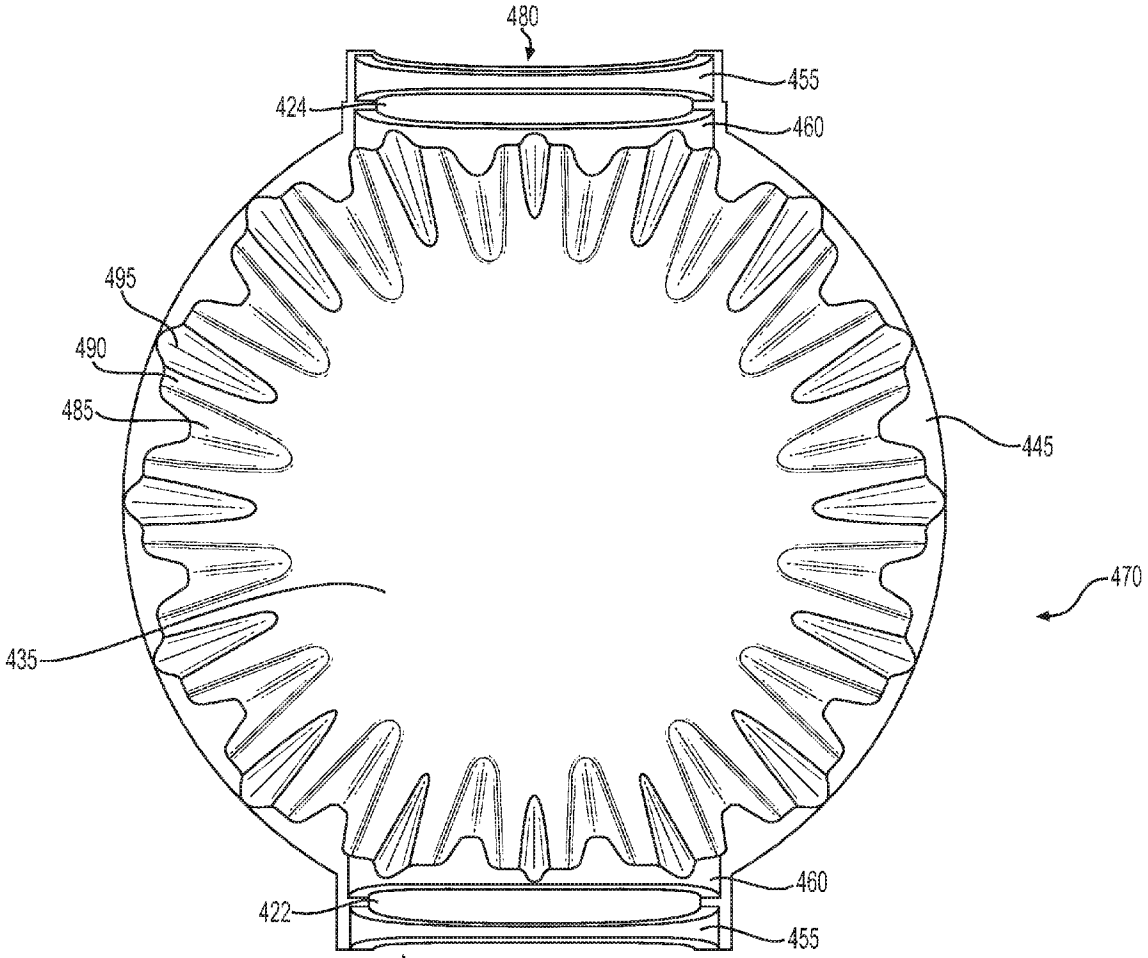
FIG. 4D is a top plan view of the single stormwater chamber of FIG. 4A according to an exemplary disclosed embodiment.

FIG. 4D illustrates a top plan view of stormwater chamber 420. Foot 445 may extend horizontally from base 470 and coupling structures 422, 424. A plurality of corrugations may originate at and extend upward from coupling structures 422, 424. As shown in FIG. 4D, three crest corrugations 490, with three crest sub-corrugations 495, and two valley corrugations 485 may originate at body corrugation 460 of coupling structures 422, 424.

Figure 5:
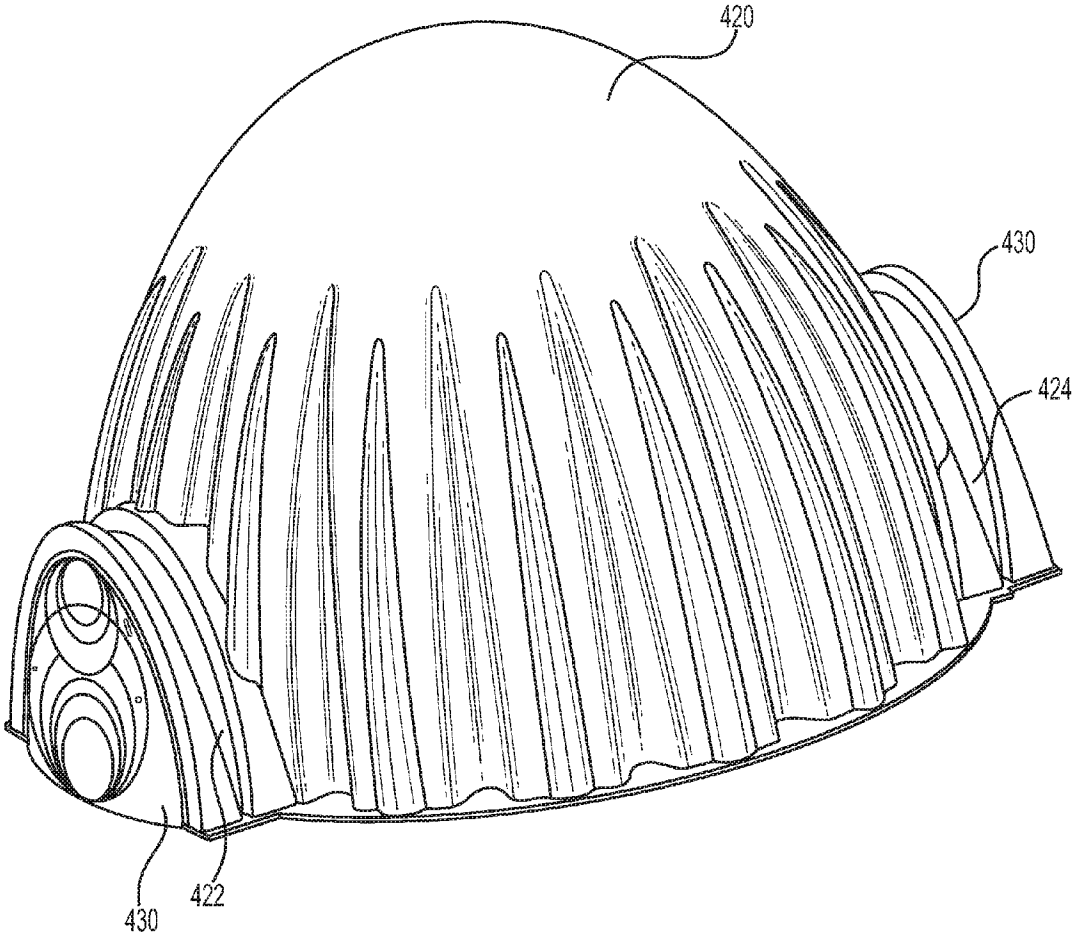
FIG. 5 is a perspective view of a single, stand-alone stormwater chamber according to an exemplary disclosed embodiment.

FIG. 5 illustrates a perspective view of a single, stand-alone stormwater chamber 420. Both coupling structures 422, 424 of stormwater chamber 420 may be fitted with endcaps 430 to create a single, stand-alone stormwater chamber.

Stormwater chambers 110, 120, 420 and stormwater chamber array 100 may be utilized for stormwater management applications. Stormwater management may involve determining stormwater levels. Stormwater levels may be determined using a combination of analyzing historical stormwater data, predicting future stormwater totals, and modeling. Stormwater management may also involve determining a desired volume of stormwater storage. Determining the desired volume of stormwater storage may involve determining the minimum, average, median, and maximum anticipated stormwater events for the site.

Stormwater management may also include selecting a number and arrangement of stormwater chambers 110, 120, 420 to accommodate the desired volume of stormwater storage. The number of stormwater chambers 110, 120, 420 may be selected by dividing the total desired volume of stormwater storage by the volume of stormwater storage that an individual stormwater chamber 110, 120, 420 provides. The desired arrangement of stormwater chambers 110, 120, 420 may be determined based on site considerations, including, but not limited to, total land area of the site and the land area and dimensions available for installing stormwater chambers 110, 120, 420. Depending on the desired application, stormwater management may also involve aligning stormwater chambers 110, 120, 420 in rows. The rows may include any number of individual stormwater chambers 110, 120, 420, depending on the drainage application and the desired storage volume. Stormwater management may also include coupling adjacent stormwater chambers 110, 120, 420. In some embodiments, stormwater management may include attaching an endcap 130 to the coupling structure 112 of stormwater chambers 110 at the ends of the rows.

As will be appreciated by one of ordinary skill in the art, the presently disclosed stormwater chamber may enjoy numerous advantages. First, stormwater chamber 110, 120, 420 may provide a stronger stormwater chamber solution than existing stormwater chambers. In particular, the continuously curving, dome shape of chamber body 235, 435 helps distribute dead and live loads around stormwater chamber 110, 120, 420 and shed those loads into the surrounding ground. The continuously curving, dome shape of chamber body 235, 435 may also reduce tensile stress and strain on wall 240, 440 of chamber body 235, 435. Accordingly, chamber body 235, 435 may provide increased strength and durability to stormwater chamber 110, 120, 420.

Second, because stormwater chamber 110, 120, 420 may be stronger due to the shape of chamber body 235, 435, it does not require any additional internal support structures for strength or stability. For example, chamber body 235, 435 may be entirely self-supporting. Because chamber body 235, 435 does not require any internal support structures, the entire volume of chamber body 235, 435 may be used for stormwater storage. Accordingly, stormwater chamber 110, 120, 420 may have a greater storage volume per land area. Reducing the land area required for a single stormwater chamber 110, 120, 420 or an array of stormwater chambers 100 has many of its own advantages, including reducing the costs associated with excavation, including time, labor, and expense.

Third, because the continuously curving, dome shape of chamber body 235, 435 may allow an array of stormwater chambers 110, 120, 420 to be positioned closer together, less fill material may be required between and above stormwater chambers 110, 120, 420. This may also reduce material and labor costs.

Finally, coupling structures 112, 114, 122, 124, 422, 424 of stormwater chambers 110, 120, 420 may provide versatility and modularity. Coupling structures 112, 114, 122, 124, 422, 424 may allow for any number of stormwater chambers 110, 120, 420 to be aligned end-to-end to create a row of stormwater chambers. In other embodiments, endcaps 130, 430 may be connected to coupling structures 112, 114, 122, 124, 422, 424 to create a single, stand-alone stormwater chamber.

The many features and advantages of the present disclosure are disclosed in the detailed specification. Thus, it is intended by the appended claims to cover all such features and advantages of the present disclosure which fall within the true spirit and scope of the present disclosure. Further, since numerous modifications and variations will readily occur to those skilled in the art, it is not desired to limit the present disclosure to the exact construction and operation illustrated and described, and accordingly, all suitable modifications and equivalents may be resorted to, falling within the scope of the present disclosure.

What is claimed is:

1. A chamber, comprising:

a chamber body including a chamber wall, an apex, a base, a first opening, and a second opening;

wherein the chamber wall includes a continuous curvature from the apex of the chamber body to the first and second openings and a continuous curvature from the apex of the chamber body to the base;

wherein a height of each of the first and second openings is less than half of a height of the chamber body;

wherein a first coupling structure is integral to the chamber body and positioned around the first opening and a second coupling structure is integral to the chamber body and positioned around the second opening; and wherein each of the first coupling structure and the second coupling structure includes an end corrugation and a body corrugation.

2. The chamber of claim 1, wherein the chamber body includes a semi-ellipsoid shape.

3. The chamber of claim 1, wherein the chamber body includes a semi-paraboloid shape.

4. The chamber of claim 1, wherein the chamber body includes a semi-spheroid shape.

5. The chamber of claim 1, wherein the chamber body includes a substantially smooth outer surface.

6. The chamber of claim 1, wherein the chamber body includes at least one corrugation extending from the base toward the apex of the chamber body.

7. The chamber of claim 1, wherein the base curves outward in a horizontal direction from the first and second coupling structures.

8. The chamber of claim 1, wherein a cross-sectional shape of the chamber body along a horizontal plane above the first and second coupling structures is substantially circular.

9. The chamber of claim 1, wherein a cross-sectional shape of the chamber body along a horizontal plane above the first and second coupling structures is substantially elliptical.

10. A stormwater management system, comprising:

at least two chambers coupled together, each chamber including:

a chamber body having a chamber wall, an apex, a base, a first opening, and a second opening;

wherein the chamber wall includes a continuous curvature from the apex of the chamber body to the first and second openings and a continuous curvature from the apex of the chamber body to the base;

a first coupling structure integral to the chamber body and positioned around the first opening and a second coupling structure integral to the chamber body and positioned around the second opening wherein one of the first and second coupling structures of a first chamber is directly coupled to one of the first and second coupling structures of a second chamber.

11. The stormwater management system of claim 10, further comprising at least two rows of chambers arranged adjacent to each other.

12. The stormwater management system of claim 10, wherein the first coupling structure and the second coupling structure each includes an end corrugation and a body corrugation.

13. The stormwater management system of claim 12, wherein the end corrugation and the body corrugation of the second coupling structure of the first chamber overlaps the end corrugation and the body corrugation of the first coupling structure of the second chamber.

14. The stormwater management system of claim 12, wherein the end corrugation of the second coupling structure of the first chamber overlaps the end corrugation of the first coupling structure of the second chamber.

15. The stormwater management system of claim 13, further comprising an endcap coupled to the first coupling structure of the first chamber.

16. A chamber comprising:

a chamber body including a chamber wall, an apex, a base, a first opening, and a second opening;

a first coupling structure positioned around the first opening;

a second coupling structure positioned around the second opening;

wherein a height of each of the first and second openings is less than half of a height of the chamber body;

wherein the first coupling structure is integral to the chamber body and positioned around the first opening and the second coupling structure is integral to the chamber body and positioned around the second opening;

wherein each of the first coupling structure and the second coupling structure includes an end corrugation and a body corrugation;

wherein the chamber wall includes a continuous curvature from the apex of the chamber body to the base; and wherein the base curves outward in a horizontal direction from the first and second coupling structures.

* * * * *